US006792727B2

(12) United States Patent
Krieger

(10) Patent No.: US 6,792,727 B2
(45) Date of Patent: Sep. 21, 2004

(54) CURVED WALL PANEL SYSTEM

(75) Inventor: Kevin Krieger, New Philadelphia, OH (US)

(73) Assignee: Commercial and Architectural Products, Inc., Dover, OH (US)

( * ) Notice: Subject to any disclaimer, the term of this patent is extended or adjusted under 35 U.S.C. 154(b) by 26 days.

(21) Appl. No.: 10/241,964

(22) Filed: Sep. 12, 2002

(65) Prior Publication Data

US 2004/0049999 A1 Mar. 18, 2004

(51) Int. Cl.[7] ..... E04G 11/04; E04H 6/00; E04B 5/00; E04B 2/00

(52) U.S. Cl. ..... 52/245; 52/235; 52/506.06; 52/586.2; 52/236.2

(58) Field of Search ..... 52/245, 235, 506.05, 52/513, 236.2, 247, 249, 586.1, 586.2, 511, 506.06

(56) References Cited

U.S. PATENT DOCUMENTS

| | | | | | |
|---|---|---|---|---|---|
| 699,439 | A | * | 5/1902 | Ballou | 52/236.2 |
| 2,797,448 | A | | 7/1957 | Revell et al. | |
| 2,947,093 | A | | 8/1960 | Masters | |
| 3,251,168 | A | * | 5/1966 | Waring | 52/460 |
| 3,557,840 | A | * | 1/1971 | Maybee | 138/149 |
| 3,786,605 | A | * | 1/1974 | Winfrey | 52/235 |
| 4,021,982 | A | * | 5/1977 | Kotcharian | 52/410 |
| 4,067,155 | A | | 1/1978 | Ruff et al. | |
| 4,188,759 | A | * | 2/1980 | Liet et al. | 52/245 |
| 4,255,910 | A | * | 3/1981 | Wendt | 52/481.2 |
| 4,422,275 | A | * | 12/1983 | Baetje | 52/509 |
| 4,434,595 | A | * | 3/1984 | de Brabant | 52/236.2 |
| 4,555,877 | A | * | 12/1985 | Libra | 52/79.4 |
| 4,625,481 | A | | 12/1986 | Crandell | |
| 4,700,527 | A | | 10/1987 | Pardo | |
| 4,703,602 | A | | 11/1987 | Pardo | |
| 4,965,970 | A | * | 10/1990 | Nania | 52/82 |
| 4,977,730 | A | | 12/1990 | Pardo | |
| 5,042,215 | A | * | 8/1991 | Cremer et al. | 52/509 |
| 5,265,396 | A | * | 11/1993 | Amimoto | 52/745.12 |
| 5,271,980 | A | * | 12/1993 | Bell | 428/68 |
| 5,555,690 | A | * | 9/1996 | Cosentino | 52/506.08 |
| 5,619,834 | A | * | 4/1997 | Chen | 52/509 |
| 5,673,529 | A | * | 10/1997 | Treister et al. | 52/511 |
| 5,816,013 | A | | 10/1998 | Opferbeck et al. | |
| 5,834,082 | A | * | 11/1998 | Day | 428/56 |
| 5,860,258 | A | * | 1/1999 | Faith et al. | 52/236.2 |
| 6,202,377 | B1 | | 3/2001 | Krieger | |
| 6,289,646 | B1 | * | 9/2001 | Watanabe | 52/506.01 |
| 6,446,399 | B1 | * | 9/2002 | Lecours | 52/81.2 |
| 6,499,261 | B2 | * | 12/2002 | Hikai | 52/235 |
| 2001/0011443 | A1 | * | 8/2001 | Watanabe et al. | 52/506.05 |

* cited by examiner

*Primary Examiner*—Carl D. Friedman
*Assistant Examiner*—Kevin McDermott
(74) *Attorney, Agent, or Firm*—Pearne & Gordon LLP

(57) ABSTRACT

The invention comprises a system for constructing a finished convex or concave curved wall of any desired radius beyond a specified minimum. The wall is constructed of pre-finished rectangular panels retained on a sub-wall structure in horizontal rows and vertical columns. The panels are retained on the sub-wall structure with vertical rails at their vertical edges and retainer clips spaced along their horizontal edges. The panels are slotted at their rear face to provide rigidity in the vertical direction and flexibility in the horizontal direction. The horizontal edges of the panels are kerfed to receive the retainer clips and flexible splice strips that conform to the curvature of the wall and align and space a panel with the panel immediately above it. Clips attaching vertical edges of the panels to the rails allow the associated areas of the panels to align tangentially with the curvature of the wall.

22 Claims, 3 Drawing Sheets

CURVED WALL PANEL SYSTEM

BACKGROUND OF THE INVENTION

The invention relates to wall construction and, in particular, to a system utilizing factory built panels and associated hardware for constructing curved walls.

PRIOR ART

Architects and/or building owners may specify curved interior walls to give rooms, partitions, corridors and the like a unique look, to create a focal point in the interior of the building, or otherwise depart from ordinary planar walls. Where the walls are to be finished with a hard finish other than plaster or drywall, it has often been the practice to construct a curved wall with custom millwork. This custom work, under most circumstances, is costly, because of the skilled labor and custom made panels or planks which, typically, are employed to create the curved surfaces. Consequently, architects and builders are restrained, due to the costs, from freely using their creativity in designing non-planar walls. Moreover, because each custom installation is just that, the final fit and finish of a custom built curved wall may be less than what is originally specified by the architect, thereby leading to further difficulties and controversies.

SUMMARY OF THE INVENTION

The present invention provides a system of pre-manufactured panels and integrated hardware that produces concave or convex walls with a consistent high-quality appearance. The system utilizes specially fabricated rectangular panels of a height and width suitable for the customer's application. The panels are uniquely cut with dado slots on their rear faces to obtain horizontal flexibility and vertical stiffness. The panels have two opposed edges, normally the horizontal edges, kerfed to accept a spline and wall attachment clip while the other edges, typically the vertical edges, are square cut. The outer decorative face of a panel can take a variety of forms such as wood veneer, high-pressure laminate, metal veneer, or other known finishes.

In accordance with the invention, the panels are interlocked to one another and retained against a sub-wall by special clips situated at the perimeter of each panel. Preferably, the spline used to join horizontal edges of adjacent panels is a flexible material such as extruded PVC so that it is readily manually bent on site into the radius of the wall. The vertical edges of adjacent panels are interconnected by joining them to vertical main rails with the use of panel clips secured to the rear faces of the panels. The main rails are attached to the sub-wall or framework and the panels, in turn, are fixed to the main rails by the panel clips. Advantageously, the slotted design of the panels as well as the character of the main rails, panel clips, retainer clips, and splines, enable the panel system to be used with any desired radius of curvature, both convex or concave above a certain minimum specified radius. Thus, the wall can have a changing radius and/or a serpentine configuration, as desired. As used herein, the term "cylindrical" is meant to describe a plane curved about one or more parallel axes.

The disclosed panel system affords the look of custom millwork with high quality fit and finish, but at substantially lower cost than custom millwork. Additionally, the system enables a wall to be installed with less time and less skill than required by custom millwork. The unique hardware assures consistent alignment between adjacent panels without exposed fasteners or clips to achieve a handsome, quality appearance.

DESCRIPTION OF THE PREFERRED EMBODIMENT

Figure 1:
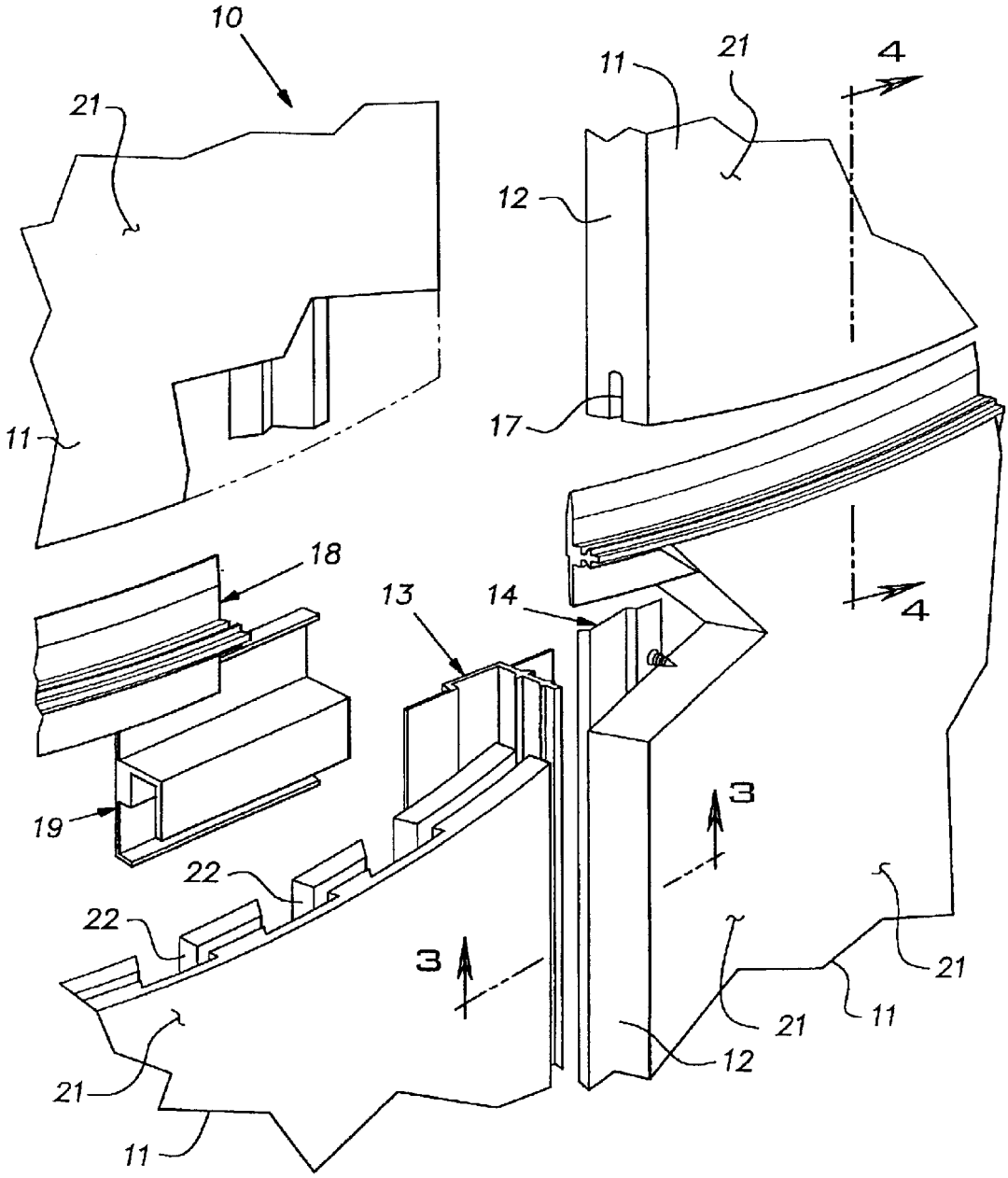
FIG. 1 is an exploded fragmentary perspective view of the curved wall panel assembly of the invention.

Referring now to the drawings, a curved wall panel system 10 in accordance with the invention includes a plurality of rectangular panels 11. In the following description, the panels and related hardware are indicated to have certain orientations which will produce a wall that is curved in a vertical column. The same parts can be turned 90° to produce a wall, arch, or ceiling that is curved in a horizontal column or turned in some other angle to produce a wall that is curved in an inclined column. Opposite vertical edges 12 of the panels 11 are joined or coupled to adjacent panel edges with main rails 13 and panel clips 14. Opposite horizontal panel edges 16 have kerfs or slots 17 to receive a spline or splice 18 and retainer clips 19.

The panels 11 are ordinarily rectangular in shape, it being understood that this description includes the condition of being square. The panels 11, for the most part, will have the same shape and size but this need not be the case. Typically, the size of the panels both vertically and horizontally can be selected to compliment the application. The long dimension of a panel 11 typically would run in the horizontal direction but, if desired, can be arranged to run in the vertical direction; that is to say, the long dimension of a panel can run in a direction parallel to the axis of the cylindrical plane of the wall, or can run circumferentially along the cylindrical surface of the wall. Preferably, the panel 11 is fabricated of ¾" thick wood composite material forming a core 15. An outer decorative panel face 21 can be laminated to this composite core 15 at the factory to satisfy a customer's specifications. The decorative panel face may comprise, for example, wood veneer, high pressure laminate, sheet metal or other known finish materials. The edges 12, 16 can be stained, painted, laminated or the like with a color or finish to coordinate with the decorative outer face 21. As shown, the vertical edges 12 are square cut. A rear face 22 of a panel 11 is machined with dado cuts in a direction parallel to the axis of the cylindrical section in which a panel is to be formed by bending or flexing action. The dado cuts or slots 22 are generally evenly spaced across the panel 11 and run the full distance between the kerfed edges 16. As shown, the dado cuts 22 are in the shape of a dovetail such that the greatest width of a slot exists adjacent the finish face 21. This configuration of the slots 22 achieves a high degree of flexibility in the horizontal direction while retaining stiffness in the perpendicular or vertical direction since the section modulus of the panel material between the slots is greater than that which would exist if the slots were rectangular in shape and had a width the same as the maximum width of the dado slot 22. The dado cuts 22 are spaced a sufficient distance from the edges 12 to permit convenient, reliable attachment of the panel clips 14.

Figure 3:
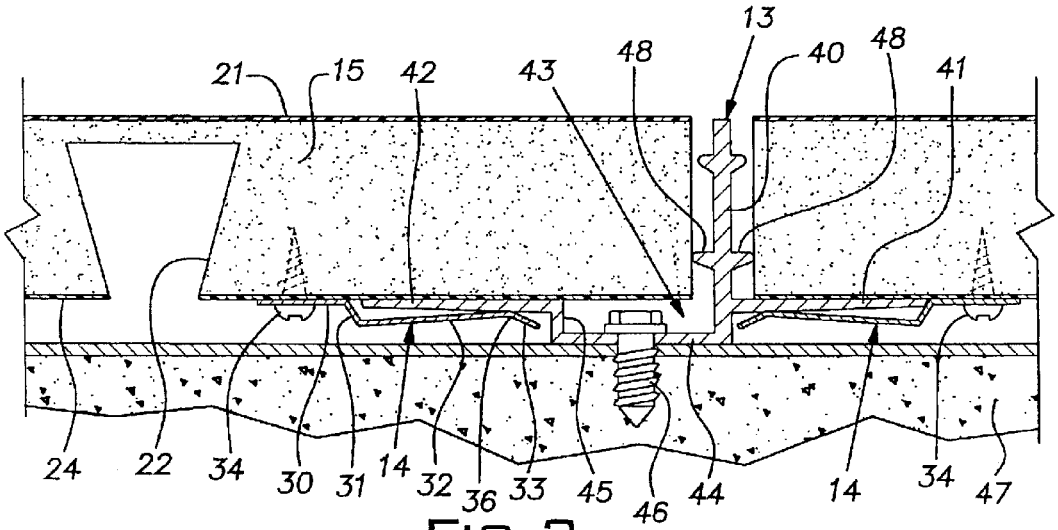
FIG. 3 is a cross-sectional fragmentary view of the curved wall panel assembly taken in the plane 3—3 shown both in FIG. 1 and FIG. 2.
Figure 5:
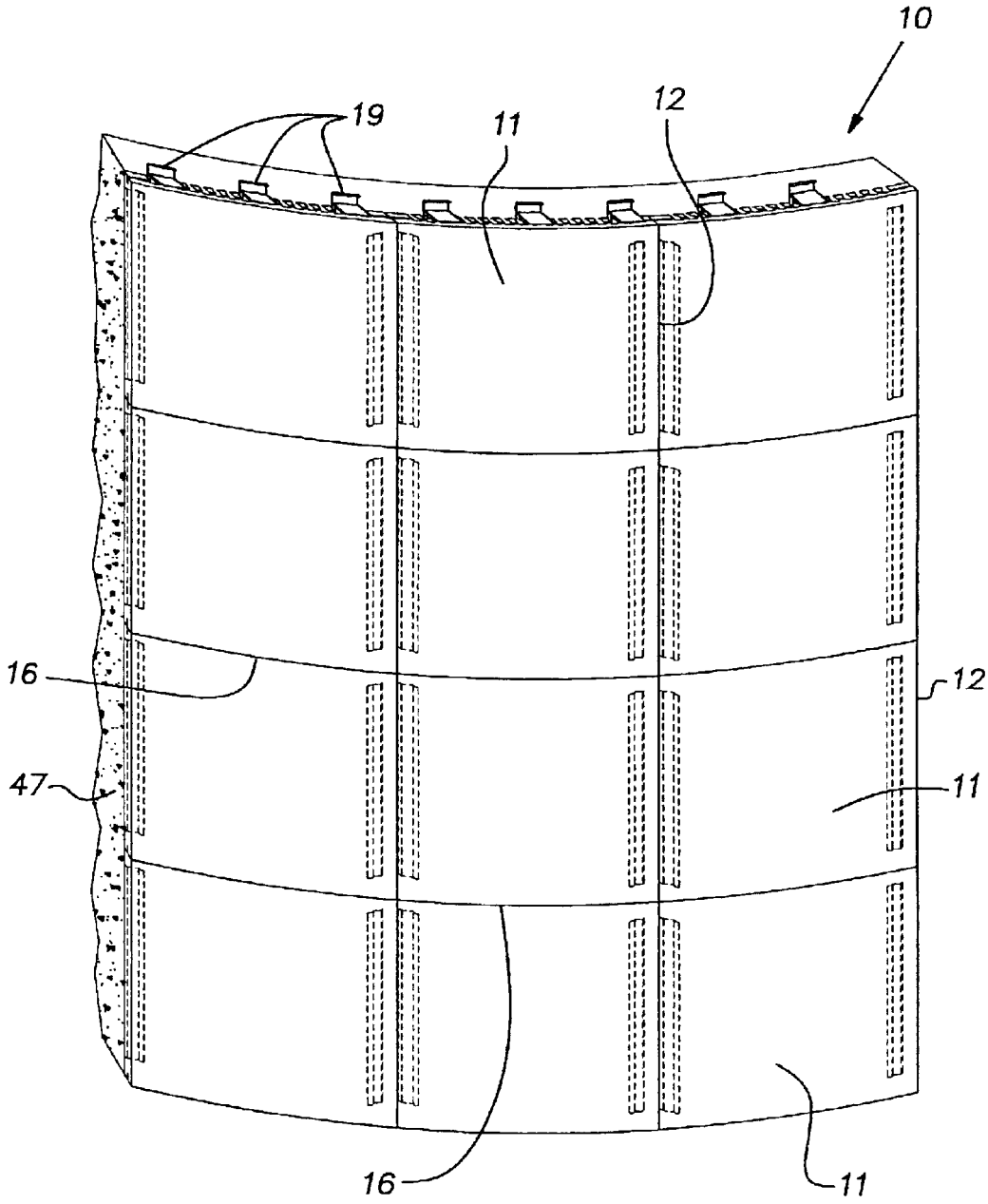
FIG. 5 is a schematic representation of a curved wall constructed in accordance with the invention.

The panel clips 14 are preferably roll-form galvanized 24 gauge steel strips that are somewhat shorter, e.g. 4" shorter than the vertical height of a panel 11 and are attached to the panel such that they are centered in the vertical dimension. As indicated in FIG. 3, the cross-section of the panel clips takes a form similar to a narrow Z-shape. More particularly, the clip includes a base flange 30, a short web 31, a main flange 32, and a minor flange 33. The base flange 30 is provided with spaced holes to receive fastening screws 34 screwed into the panel core 15 to attach the base flange firmly on the panel 11. In its free configuration, a panel clip 14 with its base flange 30 abutted to a rear face 24 of the panel core 15, can have a bend line or corner 36 between the main and minor flanges 32, 33 touching or nearly touching the core so that, as described later, it can firmly grip a part of a main rail 13. As shown in FIG. 3, the web 31 holds the main flange 32 away from the core 15 to permit a part of a main rail 13 to be received between it and the adjacent area of the core or panel 11. The panel clips 14 are assembled on the rear faces 24 of the core 15 in parallel alignment with the adjacent edges 12.

A main rail 13 is disposed between vertical edges 12 of adjacent panels 11. The main rails 13 are rigid elements preferably made of extruded aluminum. A cross-section of a main rail 13 is illustrated in FIG. 3. The main rail 13 includes a generally centralized rib 40 adapted to separate the vertical edges 12 of adjacent panels 11 and a pair of oppositely extending flanges 41, 42. A channel 43, formed by a portion of the rib 40, a web 44 and a flange 45, exists between the rib and flange 42. The channel or formation 43 receives hex head screws or like fasteners 46 and thereby ensures that there is no interference between such fasteners and the adjacent panel 11. The channel 43 and, particularly the flange 45 and corresponding portion of the rib 40 allow the flanges 42, 41, respectively, to stand off a sub-wall structure or sub-framework indicated by the numeral 47 to which the main rail 13 is attached by the screws 46. This standoff or spaced relation between the flanges 41, 42 and sub-wall structure 47 allows the panel clips 14 to be received in the space between these flanges 41, 42 and the sub-wall 47. With reference to FIG. 3, it will be seen that the central rib 40, having oppositely extending beads 48 or equivalent structure, is adapted to properly space and vertically align the panels 11.

Figure 4:
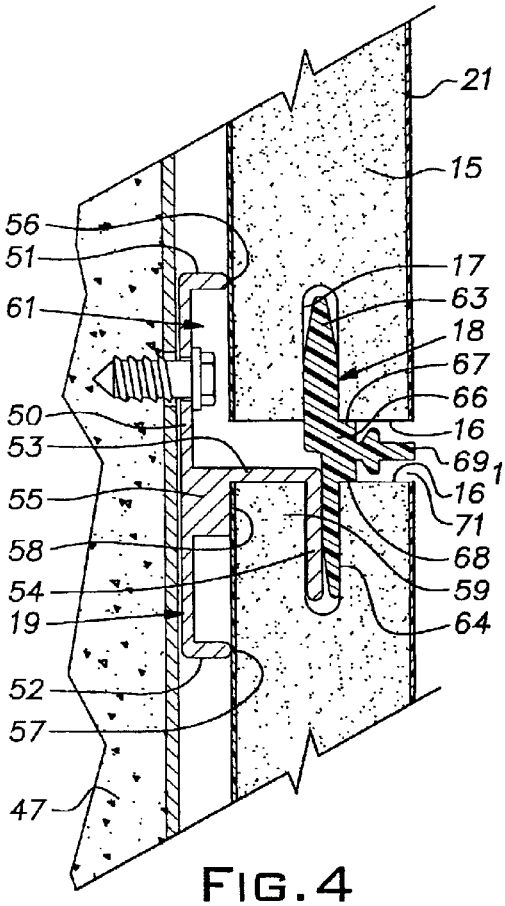
FIG. 4 is a fragmentary cross-sectional view of the curved wall assembly taken in the plane 4—4 shown in FIGS. 1 and 2.
Figure 2:
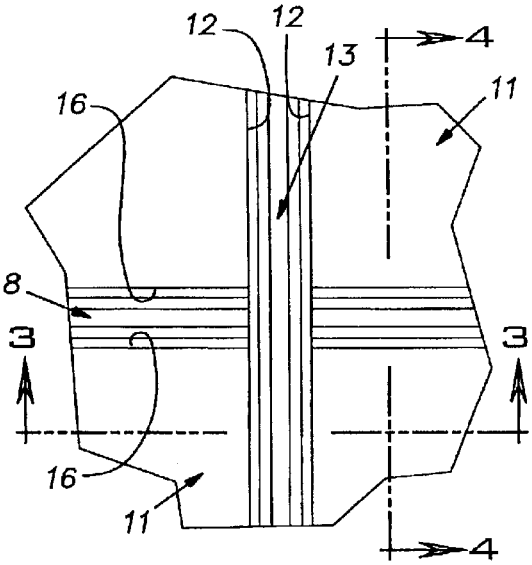
FIG. 2 is a fragmentary elevational view of the curved wall panel assembly of the invention.

With reference to FIG. 4, a retainer clip 19 is shown in cross-section or profile. The retainer clip is conveniently made of extruded aluminum or other suitable material and is relatively short being, for example, about 2" long. The profile of the retainer clip 19 is similar to a lower case "h". A vertical part of the retainer clip section includes a web 50 having upper and lower horizontally extending flanges 51, 52. Near the mid-section of the web 50, the clip 19 includes a wall 53 extending horizontally from the web 50. Integral with a free edge of the wall 53, is a depending flange 54. An integral rectangular bar 55 exists at the intersection of a lower face of the wall 53 and the web 50. Vertical edges 56, 57, of the flanges 51, 52 and a vertical face 58 of the bar 55, lie in a common vertical plane and are adapted to operate to standoff or hold the panels 11 a predetermined distance away from the sub-wall or sub-framework 47, this distance being the same as the predetermined standoff distance developed by the flanges 41, 42 of the main rails 13. The depending flange 54 is spaced from the plane of the edges 56, 57, and surface 58 so that it fits in the kerf 17 on the upper horizontal edge 16 of a panel 11 and so that it captures a section 59 of the panel edge 16 formed when the kerf is cut into this edge, preferably with a snug or push fit. A channel-like area 61 formed between the flange 51 and wall 53 receives a hex head screw or like fastener to secure the retainer clip 19 and, therefore, the associated panels 11 to the sub-wall 47. The retainer clips 19 are located at spaced intervals along the upper horizontal edges 16 of the panels at an appropriate spacing of, for example, 8". The spline 18, preferably, is extruded of flexible polyvinylchloride. Other bendable or pliable materials are contemplated, such as rubber or other elastomeric material, or malleable material such as soft extruded aluminum. The spline 18 is precut to a length that matches the horizontal dimension of the panels 11. The spline 18 has the general shape of a "T". An upper part 63 of the spline fits snugly in the kerf 17 of the lower horizontal edge 16 of the superjacent panel 11 while a lower part 64 of the spline has a reduced thickness to enable it to fit in a kerf 17 on the upper edge 16 of the subjacent panel 11 along with the retainer clip flange 54. It will be understood that the width of the kerfs 17 on the upper and lower horizontal edges 16 is the same for the sake of simplicity in manufacture of the panels 11. At the vertical mid-section of the spline cross-section, the spline 18 includes an integral bar-like formation 66 having upper and lower horizontal surfaces 67, 68. The lower horizontal surface 68 is adapted to bear against the upper horizontal edge 16 of the subjacent panel while the upper surface 67 is adapted to support the superjacent panel 11 by engagement with the lower horizontal surface of such panel. A decorative formation 69 can be integrated with the bar formation 66 of the splice to provide a finish for a vertical gap 71 between the upper and lower horizontal edges 16 of adjacent panels 11. It will be understood that the splice 18 vertically and horizontally (in and out of the plane of the wall) aligns the panel edges 16 with which it is engaged.

From the foregoing description of the system 10, its assembly is self-evident. Ordinarily, panels 11 are stacked one over the other for the full height of a wall. Suitable base trim blocking, not shown, can be utilized to support the bottom row of panels or, the bottom row of panels can simply rest on the floor. A main rail is attached to the sub-wall 47; the main rail may be modified as needed, where a curved wall starts so that it can be concealed by suitable trim, if desired. With the first main rail 13 or its equivalent installed in a vertical orientation, the panel clip 14 of the first panel 11 is slid over the flange 42 of the main rail 13. The upper edge of this panel is attached to the sub-wall 47 with retainer clips 19 by positioning their depending flanges 54 into the kerf 17 on the upper horizontal edge 16 of the panel. The retainer clips 19 can be positioned with regular spacing along this edge such as on 8" centers. It will be understood that the retaining function of the clips 19 will cause the panel to assume a radius of curvature corresponding to that of the sub-wall 47, either convex or concave by flexing or bending the panel. The spline 18 is likewise manually bent on site into the curvature of the panel and forced into the kerf 17 on the upper horizontal edge 16, the thinner flange or lower part 64 being oriented downwardly. Thereafter, the next vertical panel 11 is installed by sliding its panel clip 14 over the flange 42 of the main rail and fitting its kerf 17 on its lower horizontal edge 16 over the upper part or flange 63 of the underlying spline 18. Successive panels 11 are installed one over the other in the same manner as described above.

Next, another main rail 13 is installed by fitting its flange 41 into the space between the panel clips 14 and rear faces 24 of the first column of installed panels 11. The main rail 13 is installed so that the channel 43 remains temporarily exposed to receive the mounting screws 46. After this rail is secured by the screws 46, another column of panels 11 is assembled on the sub-wall 47 and this process is repeated column by column until a wall is completed. The last column of panels 11 can be fitted with suitable trim as desired; similarly, top and bottom horizontal trim can be used at the floor and ceiling.

From the foregoing disclosure, it will be seen that a curved wall can be constructed with essentially any desired radius greater than a minimum of, for example, 7'. The wall installation requires relatively little labor and skill to afford a custom quality look. The connection between the panel clips 14 and main rails 13 is somewhat self-adjusting due to the ability of the panel clips 14 to flex slightly so as to allow the cantilevered bend line 36 to be displaced away from the rear face 24 of a panel and, thereby allow the vertical edge area of a panel to conform or be somewhat tangent to the curvature imposed on the panel 11 by the sub-wall 47.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A curved wall assembly comprising a plurality of bendable rectangular panels retained on a cylindrical base structure in an array where the panels are in vertical columns and horizontal rows, upper and lower horizontal edges of the panels having kerfs, and a plurality of splice strips bendable by manual forces to conform locally to the curve of the wall, the splice strips being positioned in the kerfs of adjacent horizontal edges of the panels, and retainer elements interconnected with the kerfs to retain the panels in curved alignment with the base structure, the splice strips being supported in the kerfs without being fixed to the retainer elements.

2. A curved wall assembly as set forth in claim 1, wherein the panels have a finish face on one side and a rear face on the side opposite the finished face, the rear face includes spaced slots to facilitate bending of the panels to conform to the curvature of the base structure.

3. A curved wall assembly as set forth in claim 2, wherein the slots are evenly spaced across a main central part of the rear face of the panels and extend vertically from the lower edge to the upper edge of a panel.

4. A curved wall assembly as set forth in claim 3, wherein each of the slots has a wider slot width adjacent the finish face compared to the slot width adjacent the rear face.

5. A curved wall assembly as set forth in claim 1, wherein the splice strip vertically spaces the adjacent panels from one another in a vertical column.

6. A curved wall assembly as set forth in claim 1, wherein the retainer elements comprise clips having portions positioned in the kerfs with the splice strips.

7. A curved wall assembly as set forth in claim 1, including a vertical rail at a zone where the vertical edges of a pair of adjacent panels confront one another.

8. A curved wall assembly as set forth in claim 7, including clips on the rear faces of said pair of adjacent panels inter-engaged with said vertical rail.

9. A curved wall assembly as set forth in claim 8, wherein said vertical rails and said retainer elements are arranged to space said panels a predetermined distance from said base structure.

10. A curved wall comprising a base wall structure and a plurality of bendable rectangular panels attached to the base structure in horizontally extending rows and vertically extending columns, the panels having horizontal edges and kerfs formed in the horizontal edges, a plurality of retainer clips gripping the panels by inter-engagement with the horizontal kerfs, the retainer clips being secured to the base wall structure and, in turn, securing the panels to the base wall structure, and a bendable splice strip capable of conforming to the curvature of the panels disposed in upper and lower kerfs of a pair of adjacent panels, one panel being disposed above the other.

11. A curved wall as set forth in claim 10, wherein the splice strip extends along substantially the entire horizontal distance between the pair of adjacent panels and forms a finished joint.

12. A curved wall as set forth in claim 10, wherein said splice strips space adjacent panels in vertical columns with a vertical gap of predetermined size.

13. A curved wall as set forth in claim 12, wherein the panels are anchored to the base wall at the vertical edges with a vertical rail attached to the base wall structure.

14. A curved wall as set forth in claim 13, wherein the vertical edges of the panels are fitted with clips, the vertical rails having oppositely extending flanges, the clips having cantilevered portions disposed between said flanges and said base wall structure.

15. A curved wall as set forth in claim 14, wherein the clips are arranged to allow the regions of the panels adjacent their edges to approach a tangential orientation to the curve of said wall.

16. A curved wall as set forth in claim 15, wherein said rail flanges are arranged to space said panels a predetermined distance from said base wall structure.

17. A curved wall as set forth in claim 16, wherein said retaining clips are arranged to space said panels said predetermined distance from said base wall structure.

18. A curved wall assembly comprising a plurality of bendable rectangular panels retained on a cylindrical base structure in an array where the panels are in vertical columns and horizontal rows, upper and lower horizontal edges of the panels having kerfs, and a plurality of splice strips bendable by manual forces to conform locally to the curve of the wall, the splice strips being positioned in the kerfs of adjacent horizontal edges of the panels, and retainer elements interconnected with the kerfs to retain the panels in curved alignment with the base structure, the panels having a finish face on one side and a rear face on the side opposite the finished face, the rear face including spaced slots to facilitate bending of the panels to conform to the curvature of the base structure, the slots being evenly spaced across a main central part of the rear face of the panels and extending vertically from the lower edge to the upper edge of a panel, each of the slots having a wider slot width adjacent the finish face compared to the slot width adjacent the rear face.

19. A curved wall assembly comprising a plurality of bendable rectangular panels retained on a cylindrical base structure in an array where the panels are in vertical columns and horizontal rows, upper and lower horizontal edges of the panels having kerfs, and a plurality of splice strips bendable by manual forces to conform locally to the curve of the wall, the splice strips being positioned in the kerfs of adjacent horizontal edges of the panels, and retainer elements interconnected with the kerfs to retain the panels in curved alignment with the base structure, wherein the retainer elements comprising clips having portions positioned in the kerfs with the splice strips.

20. A curved wall assembly as set forth in claim 19, wherein the panels have a finish face on one side and a rear face on the side opposite the finished face, the rear face includes spaced slots to facilitate bending of the panels to conform to the curvature of the base structure.

21. A curved wall assembly comprising a plurality of bendable rectangular panels retained on a cylindrical base structure in an array where the panels are in vertical columns and horizontal rows, upper and lower horizontal edges of the panels having kerfs, and a plurality of splice strips bendable by manual forces to conform locally to the curve of the wall, the splice strips being positioned in the kerfs of adjacent horizontal edges of the panels, and retainer elements inter-connected with the kerfs to retain the panels in curved alignment with the base structure, a vertical rail at a zone where the vertical edges of a pair of adjacent panels confront one another, clips on the rear faces of said pair of adjacent panels inter-engaged with said vertical rail.

22. A curved wall assembly as set forth in claim 21, wherein the panels have a finish face on one side and a rear face on the side opposite the finished face, the rear face includes spaced slots to facilitate bending of the panels to conform to the curvature of the base structure.

* * * * *